United States Patent [19]

Stähli

[11] 4,080,671

[45] Mar. 28, 1978

[54] ARRANGEMENT FOR SWINGABLE MOUNTING OF A TOILET SEAT

[75] Inventor: Paul Stähli, Jona, Switzerland

[73] Assignee: Geberit AG, Rapperswil, Switzerland

[21] Appl. No.: 718,263

[22] Filed: Aug. 27, 1976

[51] Int. Cl.[2] ..... A47K 13/12

[52] U.S. Cl. ..... 4/236; 4/240

[58] Field of Search ..... 4/236, 240, 242, 241, 4/234

[56] References Cited

U.S. PATENT DOCUMENTS

| | | | |
|---|---|---|---|
| 3,613,129 | 10/1971 | Blount | 4/236 |
| 3,670,441 | 6/1972 | Blount | 4/236 |

FOREIGN PATENT DOCUMENTS

| | | | |
|---|---|---|---|
| 185,756 | 8/1955 | Australia | 4/240 |
| 224,364 | 10/1959 | Australia | 4/236 |
| 74,515 | 12/1960 | France | 4/236 |
| 1,025,926 | 4/1953 | France | 4/240 |
| 1,050,250 | 1/1954 | France | 4/240 |
| 1,050,548 | 1/1954 | France | 4/240 |
| 41,579 | 4/1935 | Netherlands | 4/240 |
| 507,422 | 6/1939 | United Kingdom | 4/240 |

*Primary Examiner*—Henry K. Artis

*Attorney, Agent, or Firm*—Pollock, Vande Sande & Priddy

[57] ABSTRACT

A device for swingably mounting a toilet seat, adaptable to variations in position and distance of the toilet bowl, and for removal and repositioning of the cover without need for adjustment. The device comprises a support member having a downwardly facing cavity, engaged by an elongated carrier connected to a mounting stud. The carrier has an undercut groove in which a nut is guided as a clampable slide ring engaged by a set screw arranged in a bore in the support.

4 Claims, 4 Drawing Figures

Fig. 1
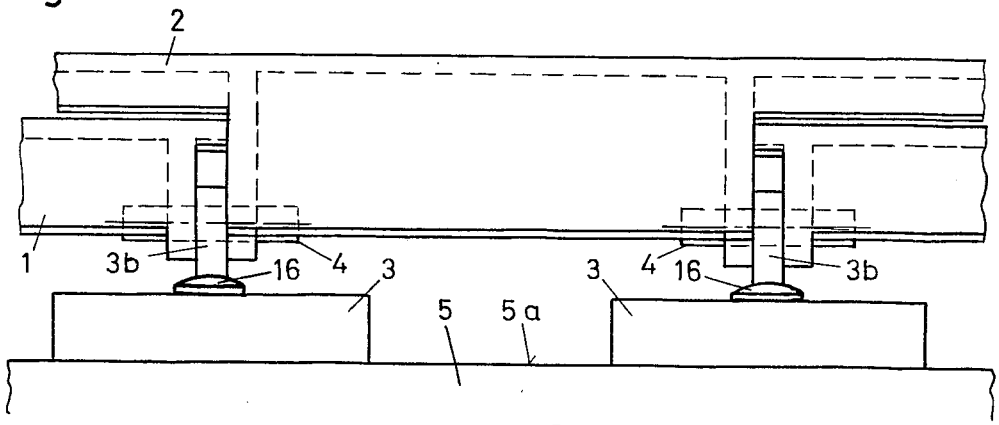
Fig. 2
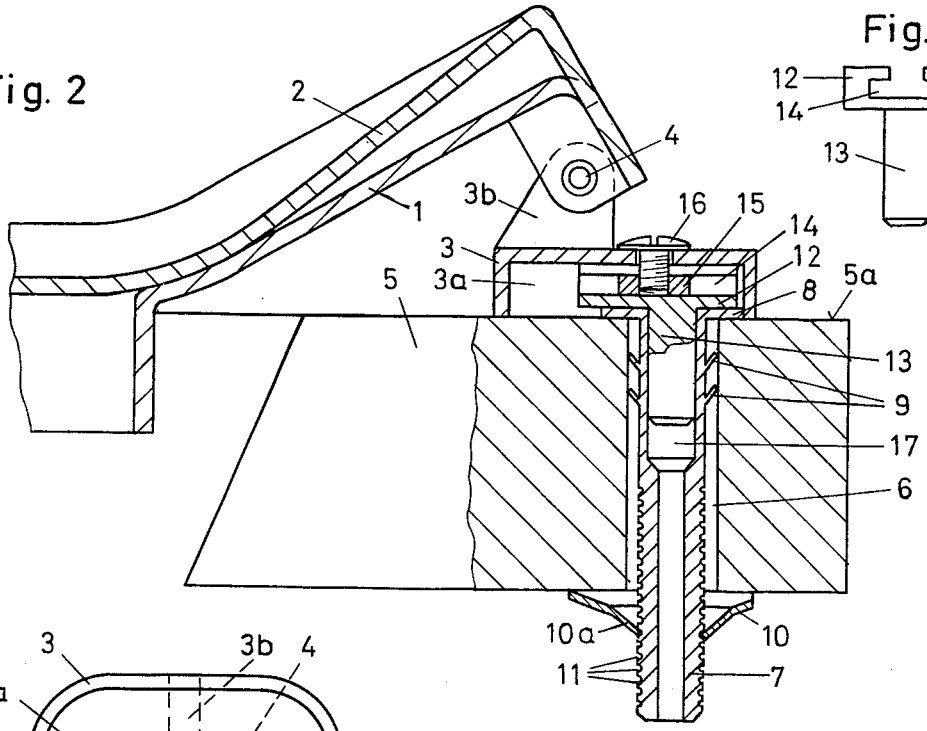
Fig. 4
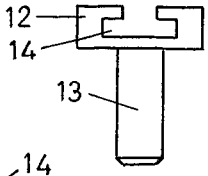
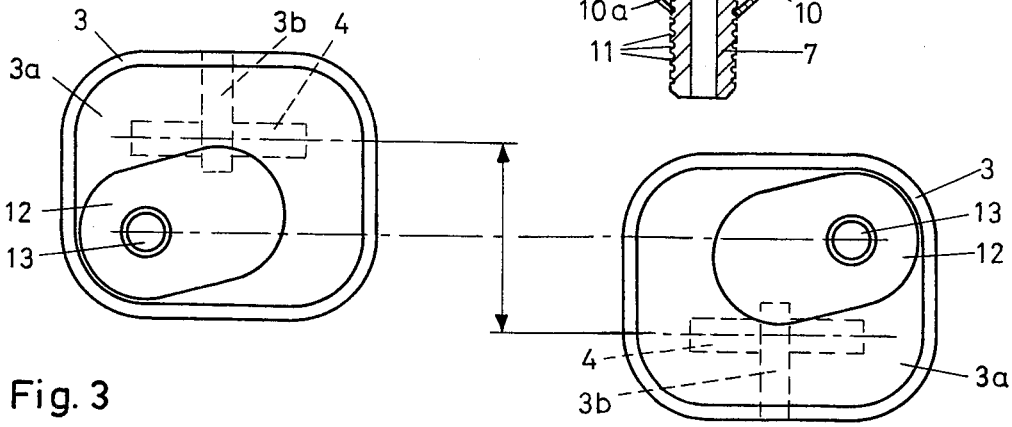
Fig. 3

ARRANGEMENT FOR SWINGABLE MOUNTING OF A TOILET SEAT

The present invention relates to a device on a toilet bowl for swingably mounting a seat ring with or without cover, including a support which carries a kingpin and is connected to a mounting stud attached in an aperture in a rim portion of the toilet bowl.

Arrangements of this type are generally known.

The object of the invention is to make such device adaptable to wide variations in the position and distance of the apertures in the toilet bowl, and to facilitate removal and repositioning of the seat ring with cover on the toilet bowl at any time, without the need for readjustment of the device.

The device according to the invention is characterized in that the support has a downwardly facing cavity engaged by an elongated carrier which is connected to a mounting stud. The carrier has an undercut groove in which a nut is guided as a clampable slide ring engaged by a set screw arranged in a bore of the support.

Preferably, the carrier is connected to a bolt which is in friction engagement with an axial bore of the mounting stud.

An embodiment of the invention will now be described with reference to the drawings, in which FIG. 1 is a partial rear view of a toilet bowl, with two devices according to the invention for the attachment of a seat ring with cover;

FIG. 2 is a vertical section through the device with its mounting stud;

FIG. 3 is a bottom view of two devices, shown in the two adjustable extreme positions; and FIG. 4 is an elevation of the carrier with the undercut groove.

The device for swingably mounting the seat ring 1 and the cover 2, shown in FIGS. 1 and 2 in assembled condition, comprises a support 3 having an underneath cavity 3*a*. Support 3 has an upwardly projecting flange 3*b* with a kingpin 4 connected to seat ring 1 and cover 2. Support 3 rests on top surface 5*a* of toilet bowl 5. Mounting studs 7 are inserted in two apertures 6 in the rim of toilet bowl 5. These bolts are made of plastic and have a flange 8 also resting on surface 5*a*. They have resilient fins 9 projecting outwardly from the stud shaft and braced by the inner walls of apertures 6. Mounting stud 7 is retained in aperture 6 by a resilient mounting plate 10 with elastically deformable portions 10*a* which engage grooves 11 extending over the entire circumference of the lower portion of the shaft of the bolt. Thus the mounting studs 7 can be easily assembled, in that they inserted from above into apertures 6 and are secured from below by sliding on the resilient mounting plate 10.

An elongated carrier 12 is arranged in the cavity 3*a* of support 3. As shown in FIG. 3, this carrier has two semicircular portions which correspond to the curvature of the cavity. Carrier 12 is connected to a bolt 13 which is in frictional contact with axial bore 17 of the mounting stud 7.

Carrier 12 has an undercut longitudinal groove 14 of T-shaped cross section. A square nut serving as a slide ring is placed in this groove. A set screw engages the nut through a bore in support 3.

During assembly, two of the devices are first attached to seat ring 1 and cover 2 by means of kingpin 4. With setscrews 16 in loosened position, bolts 13 are then inserted in the bores 17 of the mounting studs. This is easy because each carrier 12 is readily movable inside the cavity 3*a* of its support. Seat ring 1 with its cover 2 are then aligned on the toilet bowl 5. FIG. 3 shows, e.g., the possibility of adjustment along the longitudinal axis of the seat ring. After adjustment, the two set screws are tightened, thereby clamping carrier 12 on support 3. For purposes of cleaning, etc., seat ring 1 with cover 2 and the two supports 3 can easily be drawn out of the two mounting studs 7 and replaced therein, since the adjustment of bolts 13 is not changed.

Obviously, a seat ring 1 without cover 2 can also be assembled in the same manner.

I claim:

1. A device on a toilet bowl for swingably mounting a seat ring with or without cover, including (a) a support member having a downwardly facing cavity;

(b) a king pin carried by said support member;

(c) a mounting stud attached in an aperture in a rim portion of the toilet bowl and connected to said support member;

(d) an elongated carrier engaging said cavity and connected to said mounting stud;

(e) an undercut groove in said carrier;

(f) a nut guided in said groove as a clampable slide ring; and (g) a set screw arranged in a bore of said support member and engaging said nut.

2. A device according to claim 1, including a bolt connected to said carrier, said bolt being in frictional engagement with an axial bore of said mounting stud.

3. A device according to claim 1, wherein said mounting stud has a shaft surface provided with transverse grooves.

4. A device according to claim 3, including a resilient mounting plate having elastically deformable portions for engaging said transverse grooves to retain said mounting stud in fixed position.

* * * * *